US007784628B1

(12) United States Patent
Wellman

(10) Patent No.: US 7,784,628 B1
(45) Date of Patent: Aug. 31, 2010

(54) LEAK RESISTANT DRINKING CONTAINER APPARATUS

(76) Inventor: Ashley F. Wellman, 423 Metolius St., Culver, OR (US) 97734

( * ) Notice: Subject to any disclaimer, the term of this patent is extended or adjusted under 35 U.S.C. 154(b) by 234 days.

(21) Appl. No.: 12/177,276

(22) Filed: Jul. 22, 2008

(51) Int. Cl.
*A47G 19/22* (2006.01)

(52) U.S. Cl. ..... 215/11.4; 215/11.1; 215/714; 215/717; 222/514

(58) Field of Classification Search ..... 215/11.1, 215/11.4, 260, 270, 387, 388, 389; 220/203.01, 220/203.04, 203.11, 203.19, 203.16, 203.18, 220/705, 708, 711, 714, 717, 719
See application file for complete search history.

(56) References Cited

U.S. PATENT DOCUMENTS

| | | | | |
|---|---|---|---|---|
| 4,966,300 | A | 10/1990 | Coonradt | |
| 5,054,631 | A | 10/1991 | Robbins, III | |
| 5,079,013 | A * | 1/1992 | Belanger | 426/115 |
| D327,393 | S | 6/1992 | Green et al. | |
| 5,150,815 | A | 9/1992 | Saklad | |
| 5,339,982 | A | 8/1994 | Tardie | |
| 5,460,264 | A | 10/1995 | Rupert | |
| 5,678,710 | A * | 10/1997 | Sheu | 215/11.5 |
| 5,890,621 | A | 4/1999 | Bachman et al. | |
| 6,068,147 | A * | 5/2000 | Sheu | 215/11.5 |
| 6,422,415 | B1 | 7/2002 | Manganiello | |
| 7,108,676 | B2 * | 9/2006 | Loging | 604/78 |
| 7,124,907 | B2 | 10/2006 | Conaway | |
| 7,350,666 | B2 * | 4/2008 | Essebaggers | 220/714 |
| 2007/0095846 | A1 | 5/2007 | Goecke | |

* cited by examiner

*Primary Examiner*—Anthony Stashick
*Assistant Examiner*—Cynthia F Collado

(57) ABSTRACT

A leak resistant drinking container apparatus includes a container with a bottom wall, a peripheral wall and a top wall. A drinking member is integrally coupled to the container and is fluidly coupled with an interior of the container. The drinking member includes a nipple with a perimeter wall extending away from and being integrally coupled to the container. The nipple includes a distal wall with respect to the container that closes an outer end of the nipple. The distal wall has a plurality of drink apertures therein. The perimeter wall extends around an internal area of the nipple. The container has a plurality of fill apertures therein fluidly coupled to the internal area.

6 Claims, 4 Drawing Sheets

LEAK RESISTANT DRINKING CONTAINER APPARATUS

BACKGROUND OF THE INVENTION

Field of the Invention

The present invention relates to leak resistant container devices and more particularly pertains to a new leak resistant container device for holding a fluid in such a manner as to prevent leakage from the fluid and to allow for ease of use for young children.

SUMMARY OF THE INVENTION

The present invention meets the needs presented above by generally comprising a container that includes a bottom wall and a peripheral wall that is integrally attached to and extends upwardly from the bottom wall. A top wall is integrally coupled to the peripheral wall. The container is of unitary construction. A drinking member is integrally coupled to the container and is fluidly coupled with an interior of the container. The drinking member includes a nipple that extending away from the container. The nipple includes a perimeter wall extending away from and is integrally coupled to the container. The nipple includes a distal wall with respect to the container and closes an outer end of the nipple. The distal wall has a plurality of drink apertures therein. Each of the drink apertures is covered by flexible flap members to prevent fluid from flowing through the drink apertures absent suction on the nipple. The perimeter wall extends around an internal area of the nipple. The container has a plurality of fill apertures therein fluidly coupled to the internal area.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
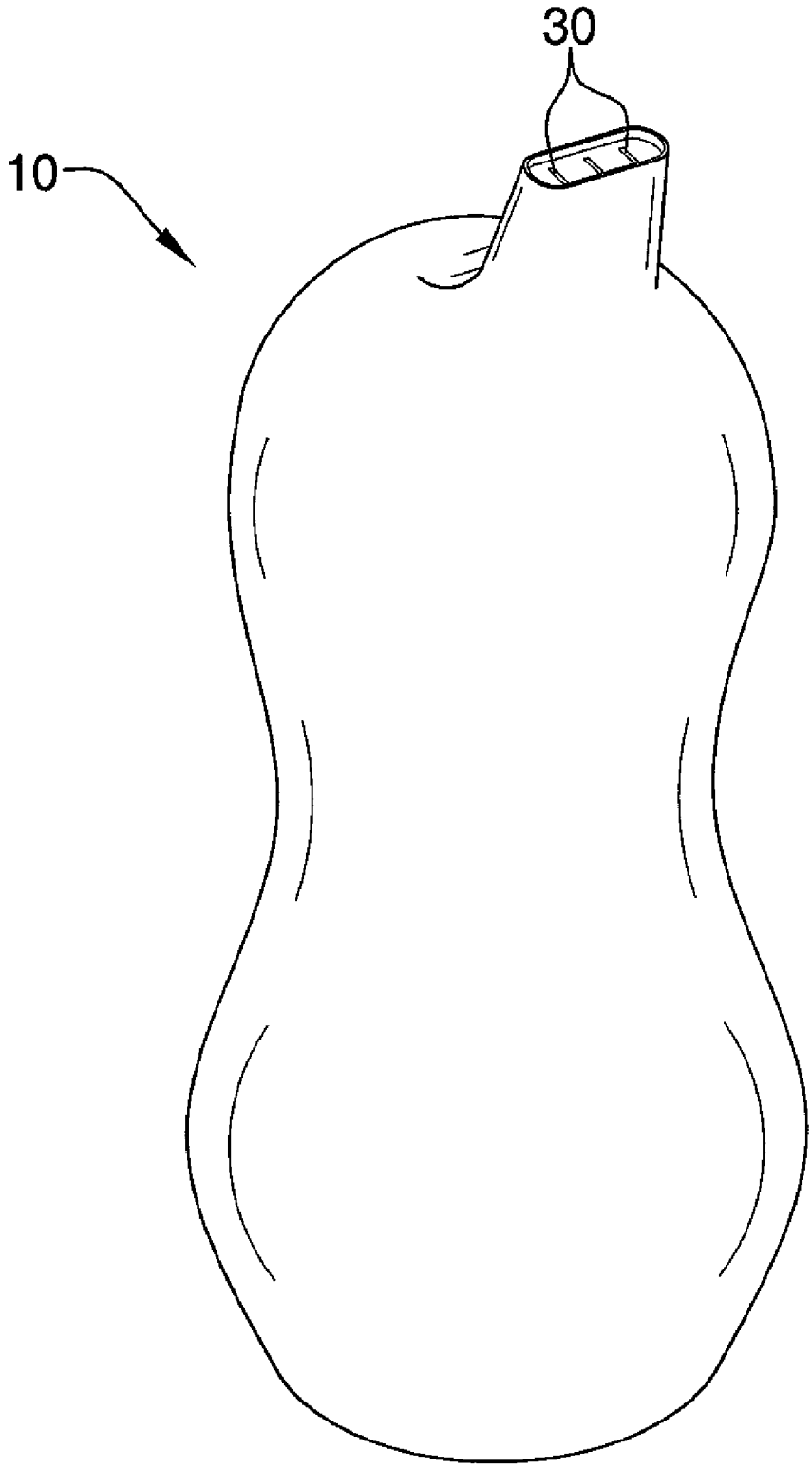
FIG. 1 is a front perspective view of a leak resistant drinking container apparatus according to the present invention.
Figure 3:
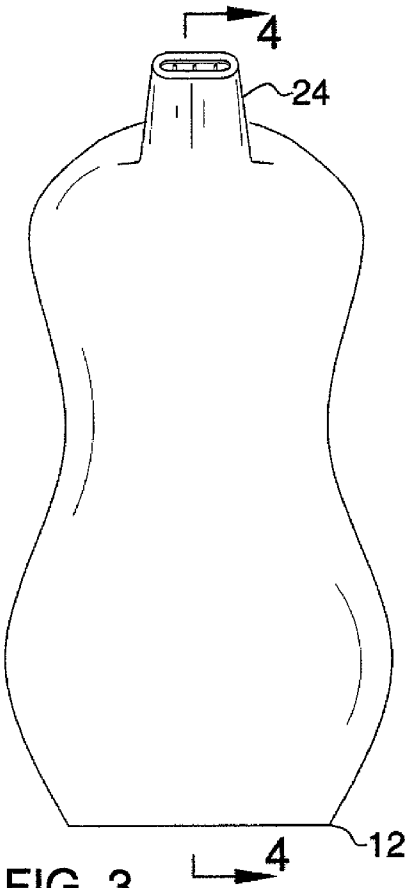
FIG. 3 is a front view of the present invention.
Figure 2:
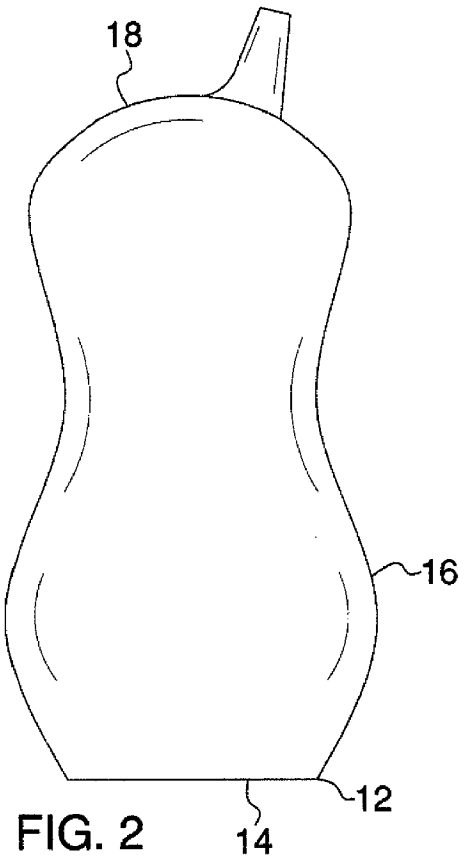
FIG. 2 is a side view of the present invention.
Figure 4:
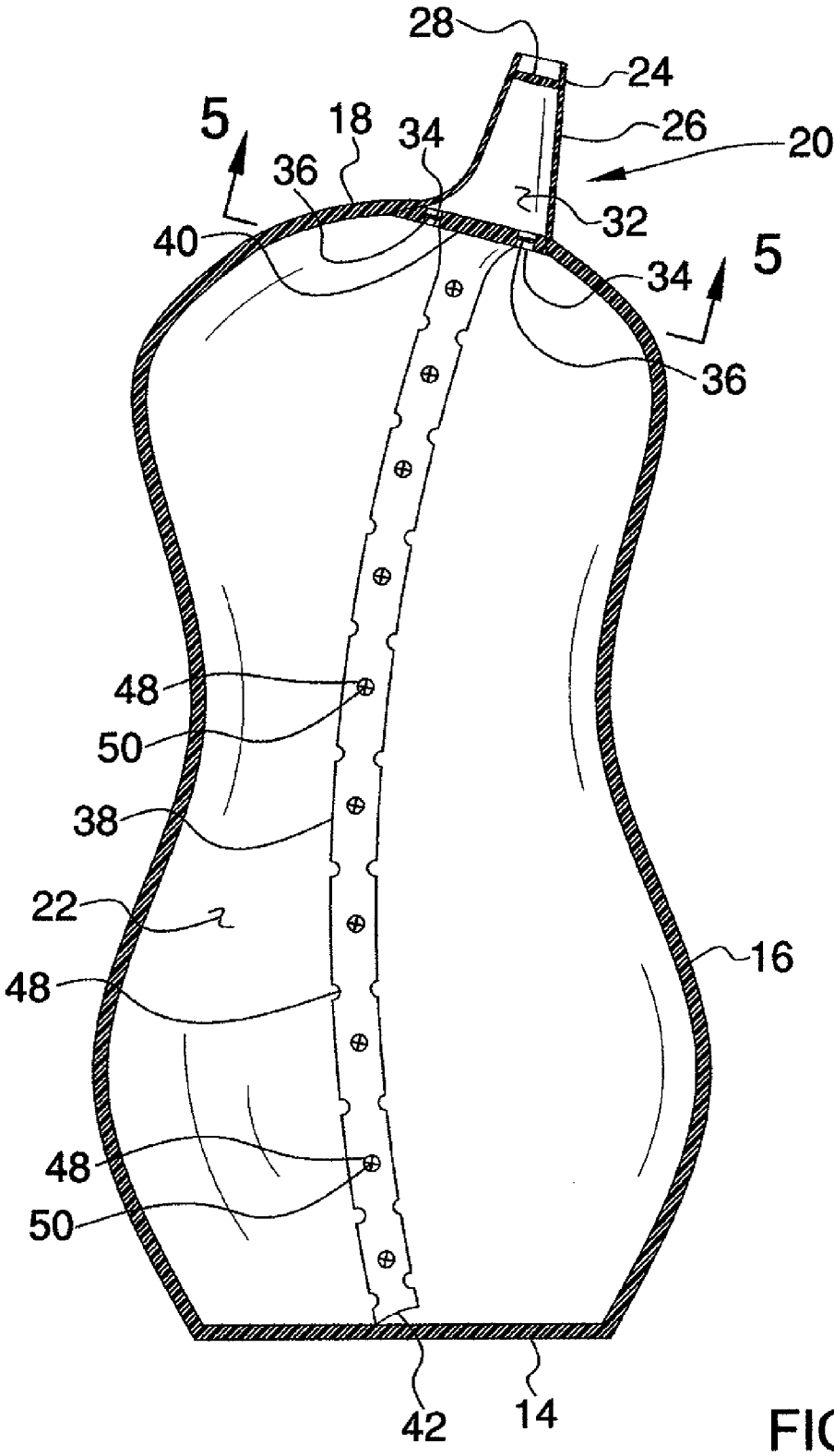
FIG. 4 is a cross-sectional view taken along line 4-4 of FIG. 3 of the present invention.
Figure 5:
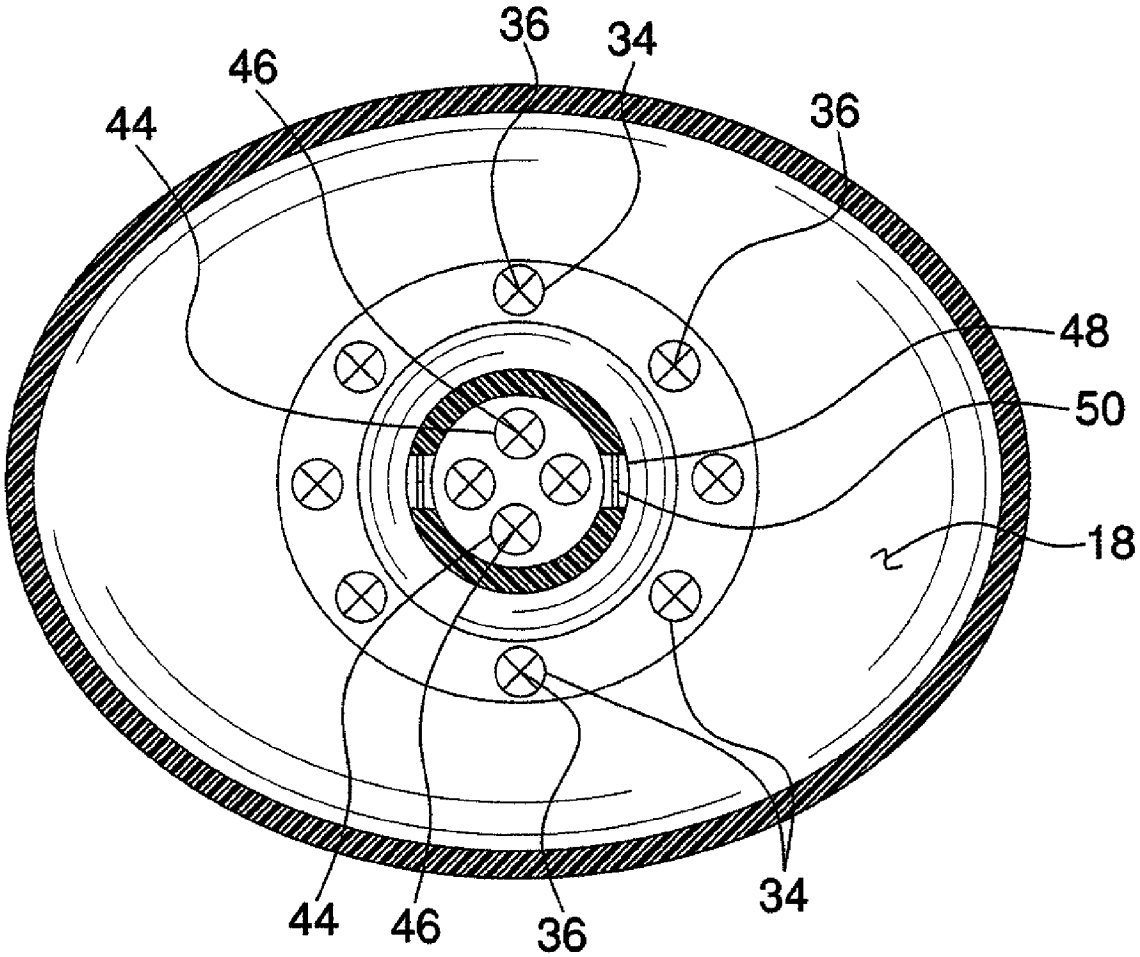
FIG. 5 is a cross-sectional view taken along line 5-5 of FIG. 4 of the present invention.

With reference now to the drawings, and in particular to FIGS. 1 through 5 thereof, a new leak resistant container device embodying the principles and concepts of the present invention and generally designated by the reference numeral 10 will be described.

As best illustrated in FIGS. 1 through 5, the leak resistant drinking container apparatus 10 generally comprises a container 12 that includes a bottom wall 14 and a peripheral wall 16 that is integrally attached to and extends upwardly from the bottom wall 14. A top wall 18 is integrally coupled to the peripheral wall 16. The container 12 is of unitary construction so that it is sealed. In particular, what this means is that the top 18, bottom 14 and peripheral 16 walls are not separable from each other to provide a sealed container. Typically the container 12 would be filled with a fluid and then the top wall 18 attached, such as by melting, to the peripheral wall 16 or the fluid would be injected into the container 12 and an inlet port used for such then would be sealed closed. The container 12 is comprised of a flexible plastic material.

A drinking member 20 is integrally coupled to the container 12 and is fluidly coupled with an interior 22 of the container 12. The drinking member 20 includes a nipple 24 extending away from the container 12. The nipple 24 includes a perimeter wall 26 extending away from and being integrally coupled to the container 12. The nipple 24 includes a distal wall 28 with respect to the container 12 that closes an outer end of the nipple 24. The distal wall 28 has a plurality of drink apertures 30 therein.

The perimeter wall 26 extends around an internal area 32 of the nipple 24. The container 12 has a plurality of fill apertures 34 therein fluidly coupled to the internal area 32. Each of the fill apertures 32 is covered by flexible flap members 36 to prevent fluid from flowing through the fill apertures 32 absent suction on the nipple 24.

A straw 38 is integrally coupled to the container 12. The straw 38 has a first end 40 attached to the container 12 adjacent to the fill apertures 32 and a second end 42 extending to an opposite end of the container 12. The container 12 has a plurality of straw apertures 44 therein fluidly coupled with the straw 38 and fluidly coupled with the internal area 22. Each of the straw apertures 44 is covered by flexible flap members 46 to prevent fluid from flowing through the straw apertures 44 absent suction on the nipple 24. The straw 38 has a plurality of suction openings 48 therein and each is covered by flexible flap members 50 to prevent fluid from flowing through the suction openings 48 absent suction on the nipple 24.

In use, the container 12 is filled with a fluid and sealed closed except for the nipple 24, straw apertures 44, suction openings 48 and fill apertures 34. However, each of these is covered with flexible flap members to prevent fluid from emptying or leaking from the container 12 when the container 12 is not in an upright position. If a large amount of negative pressure builds up in the container 12 as the fluid is sucked out it, air may flow back into the container 12 around the flap members. The container 12 may be filled, in particular, with drinks for toddlers and small children who may use it as a bottle in a convenient, disposable manner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drinking apparatus to hold a fluid and a serve a fluid for consumption, said apparatus comprising: a container including a bottom wall and a peripheral wall being integrally attached to and extending upwardly from said bottom wall, a top wall being integrally coupled to said peripheral wail, said container being of unitary construction; a drinking member being integrally coupled to said container and being fluidly coupled with an interior of said container, said drinking member including; a nipple extending away from said container, said nipple including a perimeter wall extending away from and being integrally coupled to said container, said nipple including a distal wall with respect to said container and closing an outer end of said nipple, said distal wall having a plurality of drink apertures therein; said perimeter wall extending around an internal area of said nipple, said container having a plurality of fill apertures therein fluidly coupled to said internal area and a straw being integrally coupled to said container, said straw having a first end attached to said container adjacent to said fill apertures and a second end extending to an opposite end of said container, wherein said straw has a plurality of suction openings therein, each of said suction openings being covered by a flexible flap members to prevent fluid from flowing through said suction openings absent suction on said nipple.

2. The apparatus according to claim 1, wherein said container is comprised of a flexible plastic material.

3. The apparatus according to claim 1, wherein said drinking member further includes each of said fill apertures being covered by flexible flap members to prevent fluid from flowing through said fill apertures absent suction on said nipple.

4. The apparatus according to claim 1, wherein straw being integrally coupled to said container, said straw having a first end attached to said container having a plurality of straw apertures therein fluidly coupled with said straw and fluidly coupled with said internal area.

5. The apparatus according to claim 4, wherein each of said straw apertures are covered by flexible flap members to prevent fluid from flowing through said straw apertures absent suction on said nipple.

6. A drinking apparatus to hold a fluid and a serve a fluid for consumption, said apparatus comprising:

a container including a bottom wall and a peripheral wall being integrally attached to and extending upwardly from said bottom wall, a top wall being integrally coupled to said peripheral wall, said container being of unitary construction, said container being comprised of a flexible plastic material;

a drinking member being integrally coupled to said container and being fluidly coupled with an interior of said container, said drinking member including;

a nipple extending away from said container, said nipple including a perimeter wall extending away from and being integrally coupled to said container, said nipple including a distal wall with respect to said container and closing an outer end of said nipple, said distal wall having a plurality of drink apertures therein;

said perimeter wall extending around an internal area of said nipple, said container having a plurality of fill apertures therein fluidly coupled to said internal area, each of said fill apertures being covered by flexible flap members to prevent fluid from flowing through said fill apertures absent suction on said nipple; and a straw being integrally coupled to said container, said straw having a first end attached to said container adjacent to said fill apertures and a second end extending to an opposite end of said container, said container having a plurality of straw apertures therein fluidly coupled with said straw and fluidly coupled with said internal area, each of said straw apertures being covered by flexible flap members to prevent fluid from flowing through said straw apertures absent suction on said nipple, said straw having a plurality of suction openings therein, each of said suction openings being covered by a flexible flap members to prevent fluid from flowing through said suction openings absent suction on said nipple.

* * * * *